United States Patent [19]

Pedrotte

[11] Patent Number: 4,504,999

[45] Date of Patent: Mar. 19, 1985

[54] BUFFING WHEEL HUB

[75] Inventor: Charles E. Pedrotte, Warren, Mich.

[73] Assignee: Cormat, Inc., Roseville, Mich.

[21] Appl. No.: 548,725

[22] Filed: Nov. 4, 1983

[51] Int. Cl.[3] ..... A46B 15/00

[52] U.S. Cl. ..... 15/230.1; 51/206 R

[58] Field of Search ..... 15/181, 182, 230, 230.1, 15/230.11, 230.14, 230.16, 230.19; 51/176, 206 R, 356; 192/105 A, 105 BA; 242/46.5, 68.2, 72 R

[56] References Cited

U.S. PATENT DOCUMENTS

| | | | |
|---|---|---|---|
| 981,841 | 1/1911 | Codman et al. | 15/230.14 |
| 2,110,494 | 3/1938 | Zimmerman | 15/230.1 |
| 2,455,098 | 11/1948 | Seelenfreud | 15/230.1 |
| 2,922,262 | 1/1960 | Atkins | 15/230.1 |
| 2,991,865 | 7/1961 | Wilson | 192/105 BA |

FOREIGN PATENT DOCUMENTS

| | | | |
|---|---|---|---|
| 1238227 | 7/1971 | United Kingdom | 15/181 |

*Primary Examiner*—Harvey C. Hornsby

*Assistant Examiner*—Arthur D. Dahlberg

*Attorney, Agent, or Firm*—Benjamin W. Colman

[57] ABSTRACT

A buffing wheel hub device comprising telescoping male and female units having axially extending finger members supporting a plurality of buffing wheels thereon between end plates of said units to compactly support and drive said wheels rotatably by an arbor on which said units and buffing wheels are secured and mounted for rotation. The finger members each have arbor bore adjacent portions defined by radially inclined surfaces tapering toward each other and radially extending stems of substantially lesser transverse cross-sectional thickness than the transverse cross-sectional thickness of the bore adjacent portions, whereby flexing of the finger members under centrifugal force is generated, permitting improved engagement with the buffing wheels supported thereon. The end plates have openings transversely therethrough for passage of ambient cooling air into said hub and about said finger members. The finger members of one said unit are relatively shorter than the finger members of the other said unit.

8 Claims, 5 Drawing Figures

BUFFING WHEEL HUB

BACKGROUND OF THE INVENTION

The invention relates to hubs of variable length for support of a plurality of buffing wheels used to polish the surfaces of articles and objects, particularly metal objects.

A prior art disclosure, Patterson U.S. Pat. No. 3,643,284 issued Feb. 22, 1972, contains information about a buffing wheel hub of variable length that was only relatively satisfactory in that the telescoping U-shaped members, made as a casting integrally with each end plate, did not secure the buffing wheels in a tight compact relationship. Additionally, the cast U-shaped members made the hub exceedingly heavy and cumbersome, and cut off the flow of ventilating ambient cooling air to the interior of the hub which unavoidably heats up during the buffing operation.

The improvements embodied in the hub of the instant invention provide a more flexible, lighter, more effective hub for buffing wheels.

SUMMARY OF THE INVENTION

The invention provides a hub of variable length for securing buffing wheels together upon an arbor rotatably driving the wheels at varying speeds depending upon the particular application. The hub comprises a female unit of a length somewhat less than the overall thickness of the buffing wheels to be mounted thereon, and a male unit of much shorter length such that when the two units are coupled together, the end plate of the male unit will compress the buffing wheels at their bores against the end plate of the female unit into a tight compact assembly. To effect such assembly, the units forming the hub are each provided with an end plate having a diameter greater than the buffing wheel bores which are of a common diameter, and a plurality of axially extending fingers that alternately engage with and telescope between each other. The male unit fingers, being of relatively short length, are provided with plastic inserts extending longitudinally from their distal ends on surfaces which mate or dovetail with complementary surfaces of the female unit fingers.

In addition to an axial bore in the end plates for a supporting arbor, each end plate is provided with a plurality of openings therethrough for admission and discharge of ventilating ambient cooling air passing through and about the fingers of both units. These openings lie in bolt circles within the diameter of the buffing wheel bores, allowing the ventilating air to flow over the entire length of the hub and within the compacted buffing wheels.

A threaded arbor nut compresses the male unit end plate upon the buffing wheels to compact them against the end plate of the female unit. Under the rotational speeds of the hub, the unit fingers tend to flex outwardly under centrifugal force and tighten upon and securely engage the metal rims at the bores of the buffing wheels.

Various further and more specific objects, features and advantages of the invention will appear from the description given below, taken in connection with the accompanying drawings, illustrating by way of example a preferred form of the invention. Reference is here made to the drawings annexed hereto forming an integral part of this specification.

DESCRIPTION OF THE PREFERRED EMBODIMENT

Figure 1:
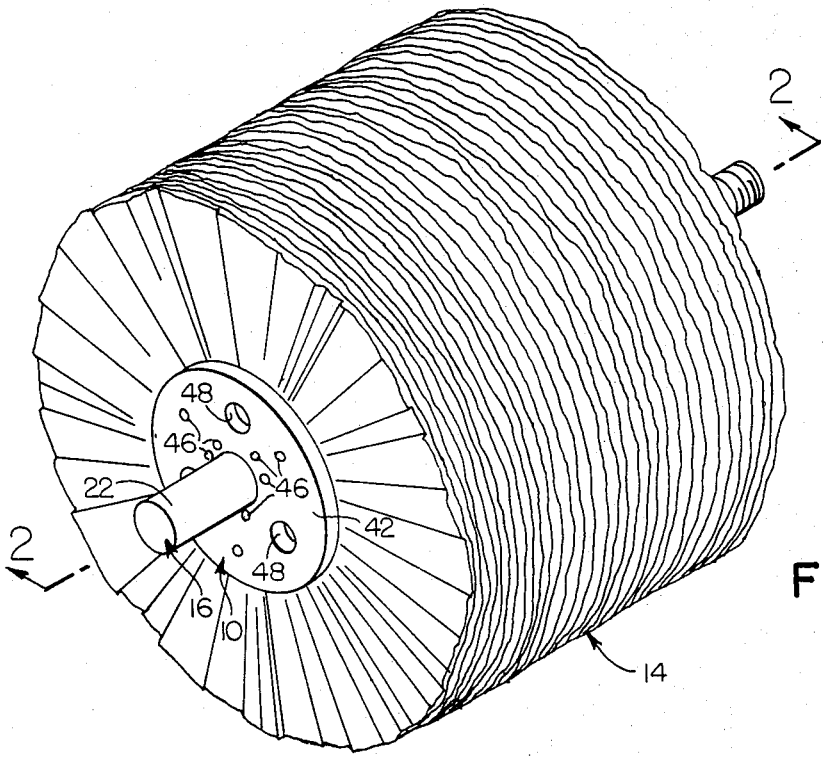
FIG. 1 is a perspective view of the hub of this invention supporting a plurality of buffing wheels.
Figure 2:
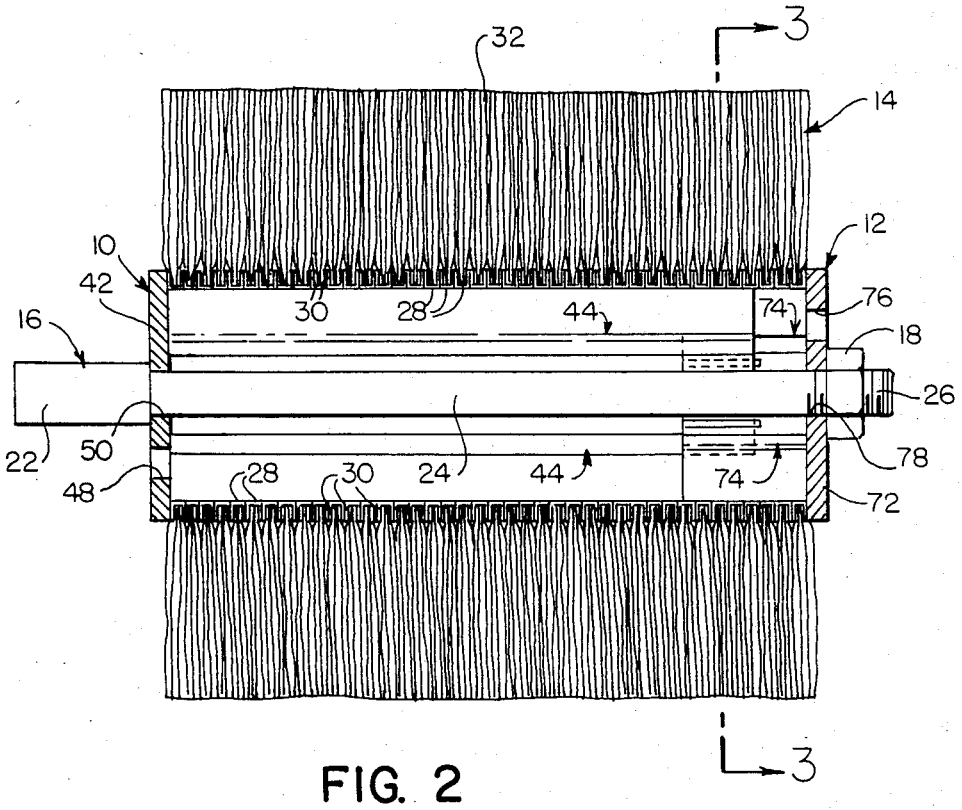
FIG. 2 is a vertical sectional view taken substantially on the line 2—2 of FIG. 1.

A preferred embodiment of the invention as illustrated in the several views of the drawings, comprises a hub female unit 10 and a complementary hub male unit 12 supporting a plurality of buffing wheels 14, an arbor 16 and an arbor nut 18.

The arbor 16 comprises a proximal end portion 22, a mid-portion 24 and a threaded distal end portion 26, the overall length of the mid-and distal end portions being greater than the overall length or thickness of the buffing wheels when compacted upon and between the female and male hub units by the arbor nut 18. The proximal end portion 22 is of a larger diameter than the bore of the female unit end plate against which it bears. Optionally, the proximal end portion 22 may be of the same diameter as the mid-portion 24 and threaded to receive a nut 18 that bears against the female hub unit. The arbor 16 and nut 18 are preferably made of steel.

The buffing wheels 14 each individually comprises a metal rim or collar 28 at its bore having lateral segments 30 that engage and attach to the buffing wheel body 32 which is made of fabric or other suitable buffing material. Buffing wheels are made in various diameters depending upon a number of factors and considerations well known in the art.

The female hub unit 10 comprises an end plate 42, a plurality of radially oriented, spaced apart, axially extending finger members 44 arranged on a bolt circle within the diameter of the buffing wheel bore rim 28, and fasteners 46, such for example as threaded screws, to secure the fingers at their proximal ends to the end plate.

The end plate 42 is disc-shaped and of a diameter slightly or somewhat greater than the overall diameter of the buffing wheel bore rim 28 including its lateral segments 30, so that the end plate fully bears upon such rims. The end plate 42 is also provided with a plurality of ventilating openings 48 on a bolt circle within the diameter of the buffing wheel bore rim 28, and with an axial bore 50 through which the arbor mid-portion 24 will pass.

Each of the fingers 44 comprises an axially extending stem or body 56 having an arbor adjacent portion 58 and a buffing wheel adjacent portion 60. The arbor adjacent portion 58 is provided with lateral, generally radially inclined surfaces 62,62 tapering toward each other and an intermediate concavely arcuate inner surface 64 therebetween substantially complementary to the peripheral outer surface of the arbor mid-portion 24. The outer edge 66 of the buffing wheel adjacent portion 60 is shown as being flat or planar; however, it can also be convexly or concavely arcuate in cross-sectional contour, as particular applications may dictate. The proximal ends of the fingers 44 abut the inner surface of the end plate 42 to which the fingers are secured by the fasteners 46.

The hub male unit 12 is similar in most respects to the hub female unit 10 but there are some important differences.

Again, the male unit 12 comprises a disc-shaped end plate 72, a plurality of radially oriented, spaced part, axially extending finger members 74 arranged on a bolt circle within the diameter of the buffing wheel bore rim 28, and fasteners 46 securing the proximal ends of the fingers to the end plate.

The end plate 72 is also of a diameter slightly or somewhat greater than the overall diameter of the buffing wheel bore rim 28 including its lateral segments 30, and is provided with a plurality of ventilating openings 76 on a bolt circle within the diameter of the buffing wheel bore rim 28, and with an axial bore 78 to pass the arbor mid- and distal end portions 24 and 26 therethrough.

Each of the hub male unit fingers 74 comprises an axially extending stem or body 82 having an arbor adjacent portion 84 and a buffing wheel adjacent portion 86. The arbor adjacent portion 84 is provided with generally radially inclined lateral surfaces 88,88 tapering toward each other and an intermediate concavely arcuate inner surface 90 therebetween substantially complementary to the peripheral outer surface of the arbormid- and threaded distal end portions 24 and 26. The outer edge 92 of the buffing wheel adjacent portion 86 is shown as being flat or planar; however, it can also be concavely or convexly arcuate in cross-sectional contour as particular applications may dictate. The proximal ends of the fingers 74 abut the inner surface of end plate 72 to which the fingers are secured by fasteners 46.

As to the differences over the hub female unit, the fingers 74 of the male unit 12 are provided with longitudinally extending plastic inserts 94 inset in the finger stem inclined surfaces 88 to bear upon the inclined surfaces 62 of the female unit figures 44 whereby sliding contact in telescoping movement of the male unit fingers 74 between the female unit fingers is relatively smooth and positive. The plastic inserts 94, preferably of nylon polyamide or equivalent material, are relatively compressible and of long-wearing character and make a relatively tight fit with the fingers 44 of the hub female unit 10. The plastic inserts extend laterally slightly above the inclined surfaces 88 of the fingers 74 in which they are disposed.

The fingers 44 and 74 of the two units are preferably made of extruded or pultruded aluminum alloy material. The end plates 42 and 72 are preferably made of steel and of a thickness such that compression of the plates upon the buffing wheel bore rims 28 and their segments 30 will not significantly deform the end plates under the tightening action of the arbor nut 18.

Another significant difference between the two hub units 10 and 12 is that the fingers 74 of the male unit 12 need only be about 4 to 6 inches in length whereas the fingers 44 of the female unit 10 can be of any suitable length and up to as much as 3 or 4 feet in length. Compression by the male unit 10 compacts the buffing wheels 14 primarily upon the female unit fingers 44, only a relatively few buffing wheels resting solely upon the fingers 74 of the male unit 12.

Figure 3:
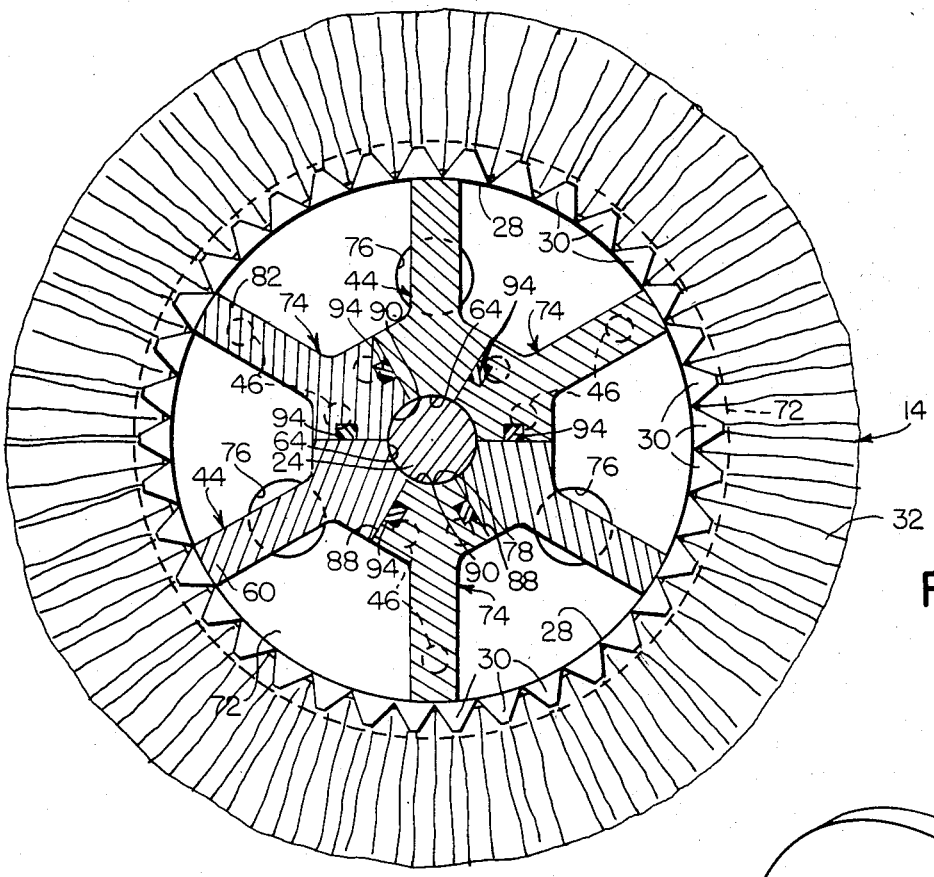
FIG. 3 is an enlarged transverse vertical sectional view taken substantially on the line 3—3 of FIG. 2.
Figure 4:
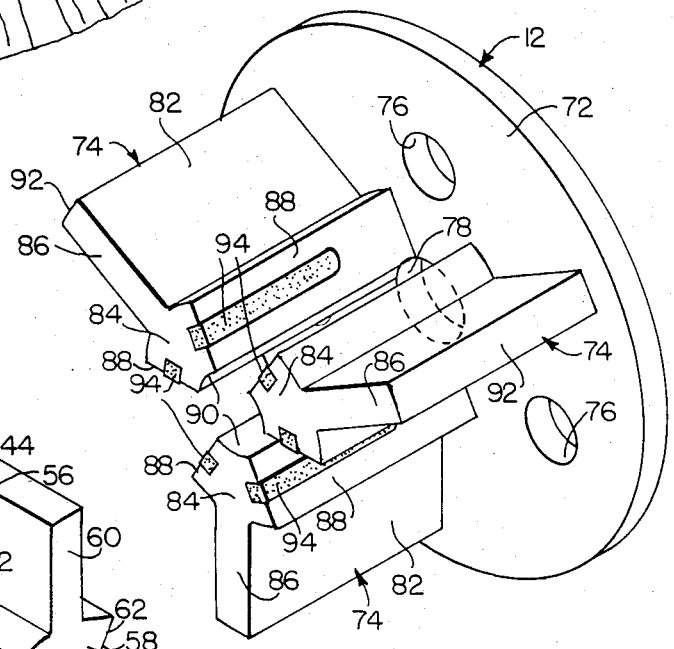
FIG. 4 is a perspective view of the hub male unit.
Figure 5:
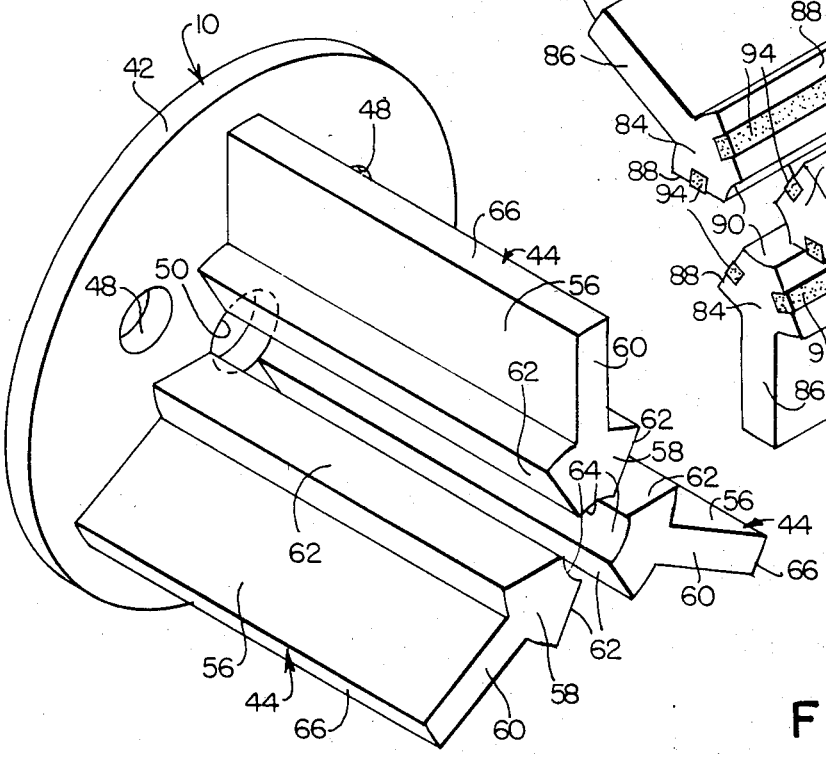
FIG. 5 is a perspective view of the hub female unit.

As shown particularly in FIG. 3, the inside and outside diameters of the fingers 44 and 74 substantially coincide in the same circles of revolution. Being longer, the female unit fingers 44 will flex outwardly under centrifugal force to a much greater extent than will the relatively short fingers 74 of the male unit 10, thereby providing a tighter and more effective grip upon the buffing wheel rims 28.

The buffing wheel hub of this invention is applied in the following manner. A plurality of buffing wheels 14 are placed upon the female unit fingers 44 until they are completely encircled and some buffing wheels remain unsupported. These latter buffing wheels are mounted upon the male unit fingers 74 which are then telescopically slid between the fingers 44 of the female unit 10, the plastic inserts 94 bearing upon and compressed against the inclined surfaces 62 of the female unit fingers 44. The male unit end plate 72 will be disposed axially beyond the distal ends of the female unit fingers 44 but the fingers 74 of the male unit will be in conjunctive support therewith of some of the buffing wheels 14 on the fingers 44.

The nut 18 is then threadedly engaged upon the distal end portion 26 of the arbor 16 and tightened against the male unit end plate 72, compressing the buffing wheel rims 28 toward and against the female unit end plate 42.

Having disclosed a certain particular preferred embodiment of the invention for purposes of explanation, further modifications or variations thereof, after study of this specification, will or may occur or become apparent to persons skilled in the art to which the invention pertains. Reference should be had to the appended claims in determining the scope of the invention.

I claim:

1. In a buffing wheel hub device for mounting a plurality of buffing wheels upon an arbor for rotation by said arbor, said device comprising female and male units secured upon said arbor and having end plates bearing upon said buffing wheels supported axially and in parallel on said units and therebetween, the improved combination comprising a plurality of radially oriented, spaced apart, axially extending female unit finger members secured to one said end plate on a bolt circle within the bore of said buffing wheels, a plurality of radially oriented, spaced apart, axially extending male unit finger members secured to a second said end plate on a substantially identical bolt circle within the bore of said buffing wheels, the finger members of one said unit being relatively shorter in length than the finger members of the other said unit to compactly secure the buffing wheels supported thereon between said end plates, said finger members of both said units having arbor adjacent portions defined by radially inclined surfaces tapering toward each other and a surface therebetween substantially complementary to the peripheral outer surface of said arbor next thereto adjacent, said finger members of both said units having buffing wheel bore adjacent portions each defined by a radial stem or body of reduced transverse cross-sectional thickness substantially less than the transverse cross-sectional thickness of said tapered arbor adjacent portions, said radial stem terminating at its distal edge closely adjacent said buffing wheel bore, said end plates having openings therethrough for passage of ambient cooling air into said hub and about said buffing wheel supporting fingers, whereby the axially extending portions of said finger members are relatively free to flex outwardly under centrifugal force generated by rotation of said arbor and more securely grip and drive said buffing wheels rotatably in their buffing operation.

2. The buffing wheel hub device defined in claim 1, wherein said hub female unit end plate is disc-shaped and of a diameter slightly or somewhat greater than the diameter of said buffing wheel bore.

3. The buffing wheel hub device defined in claim 1, wherein the proximal ends of said finger members are removably secured to said end plates.

4. The buffing wheel hub device defined in claim 1, wherein said male unit finger members are provided with longitudinally extending resilient relatively compressible inserts in their inclined surfaces to slidingly bear upon, contact and engage said female unit finger member inclined surfaces in telescoping and operating relationship.

5. The buffing wheel hub device defined in claim 4, wherein said male unit finger members are disposed in alternating contacting relationship with said female unit finger members at their said inclined surfaces.

6. The buffing wheel hub device defined in claim 1, wherein said end plates are provided with an axial bore for passage of portions of said arbor closely therethrough.

7. The buffing wheel hub device defined in claim 1, including fasteners securing said finger members at their proximal ends to said end plates.

8. The buffing wheel hub device defined in claim 1, wherein said finger member surface between said inclined surfaces is concavely arcuate in crosssectional contour.

* * * * *